US007821361B2

(12) United States Patent
Hsu

(10) Patent No.: US 7,821,361 B2
(45) Date of Patent: Oct. 26, 2010

(54) SECOND-ORDER BAND-PASS FILTER AND WIRELESS APPARATUS USING THE SAME

(75) Inventor: Min-Shun Hsu, Hsinchu (TW)

(73) Assignee: Ralink Technology Corp., Jhubei, Hsinchu County (TW)

( * ) Notice: Subject to any disclaimer, the term of this patent is extended or adjusted under 35 U.S.C. 154(b) by 173 days.

(21) Appl. No.: 12/357,371

(22) Filed: Jan. 21, 2009

(65) Prior Publication Data

US 2009/0243760 A1 Oct. 1, 2009

(30) Foreign Application Priority Data

Mar. 25, 2008 (TW) ..... 97110571 A

(51) Int. Cl.
*H01P 1/203* (2006.01)

(52) U.S. Cl. ..... 333/204

(58) Field of Classification Search ..... 333/204, 333/205, 202

See application file for complete search history.

(56) References Cited

U.S. PATENT DOCUMENTS 7,436,274 B2 * 10/2008 Shih ..... 333/204
7,551,046 B2 * 6/2009 Mei ..... 333/204
2007/0216498 A1 * 9/2007 Chen ..... 333/204
2008/0074213 A1 * 3/2008 Chen et al. ..... 333/204
2009/0243759 A1 * 10/2009 Chen et al. ..... 333/204
2010/0117765 A1 * 5/2010 Bourtoutian ..... 333/204

* cited by examiner

*Primary Examiner*—Stephen E Jones
(74) *Attorney, Agent, or Firm*—Winston Hsu; Scott Margo; Min-Lee Teng

(57) ABSTRACT

A second-order band-pass filter for generating at least two transmission zeros includes a first signal terminal, a second signal terminal, a first transmission line resonator, a second transmission line resonator and an impedance inverter. The first transmission line resonator and the second transmission line resonator are symmetric to each other and coupled to the first signal terminal and the second signal terminal, which are formed by bending two quarter-wavelength open stubs and have an open circuit gap between the two terminals. The impedance inverter includes an inductor, a first micro strip line and a second micro strip line. The first micro strip line and the second micro strip line are symmetric to each other, and are coupled to the first signal terminal and the second signal terminal and coupled to a ground through the inductor, respectively.

18 Claims, 4 Drawing Sheets

SECOND-ORDER BAND-PASS FILTER AND WIRELESS APPARATUS USING THE SAME

BACKGROUND OF THE INVENTION

1. Field of the Invention

The present invention relates to a second-order band-pass filter and a wireless apparatus using the same, and more particularly, to a second-order band-pass filter and a wireless apparatus using the same that bends two quarter-wavelength open stubs to form a cross coupling structure for generating at least two transmission zeros.

2. Description of the Prior Art

In a RF front-end circuit of a modern communications device, a band-pass filter is an important and essential component for reducing unnecessary emission of harmonics and parasitic signals from a transmitter, or enhancing noise elimination capability of a receiver when receiving signals. Generally, an operation frequency of the modern communications device is substantially located at a microwave band, and thus it is an economical and practical approach to realize the band-pass filter on a printed circuit board (PCB) in the form of a transmission line, which has in fact been applied to the wireless communications device operated in a millimeter wave band.

However, at present, such design is seldom applied to a front-end circuit of a Wireless Local Area Network (WLAN) device, especially those operated near an ISM (Industrial, Scientific and Medical) band of the United States, mainly because a high-order microwave band-pass filter is needed to achieve a sufficient Out-Band Rejection capability. Even though the high-order microwave band-pass filter has a steep cut-off frequency response characteristic, due to its large overall length or size, it often occupies too much space in the RF circuit. Thus, it is hard to realize in a standard motherboard, and is contrary to the design demands of the modern communications device, which emphasizes lightness, thinness, smallness, etc.

Please refer to FIG. 1. FIG. 1 is a schematic diagram of a conventional second-order band-pass filter 10. The second-order band-pass filter 10 is realized on a printed circuit board, and includes a first signal terminal 11, a second signal terminal 12, a first transmission line resonator 13, a second transmission line resonator 14, and an impedance inverter 15. The first signal terminal 11 and the second signal terminal 12 are for the use of signal input and output. The first transmission line resonator 13 and the second transmission line resonator 14 are respectively coupled to the first signal terminal 11 and the second signal terminal 12, and are a pair of quarter-wavelength open stubs that are symmetric to each other and extend in opposite directions, wherein characteristic impedance and electrical length of each quarter-wavelength open stub are represented by Z1 and θ1, respectively. The impedance inverter 15 is coupled between the first transmission line resonator 13 and the second transmission line resonator 14, and includes a first micro strip line 154, a second micro strip line 156 and an inductor 152. The first micro strip line 154 has one end coupled to the first signal terminal 11, and the other end coupled to a ground GND through the inductor 152. The second micro strip line 156 is symmetric to the first micro strip line 154, and has one end coupled to the second signal terminal 12 and the other end coupled to the ground GND through the inductor 152 as well. Characteristic impedance and electrical length of the first micro strip line 152 and the second micro strip line 154 are represented by Z2 and θ2, respectively.

Since the quarter-wavelength open stub is equivalent to a series resonance circuit, and the impedance inverter 15 is utilized for providing electrical coupling and impedance matching for the two series resonance circuits, i.e. the first transmission line resonator 13 and the second transmission line resonator 14, a frequency response of the second-order band-pass filter 10 is substantially similar to that of a lumped-type second-order band-pass filter. The parameters of each transmission line (Z1,θ1, Z2 and θ2) and the size of the grounding inductor 152 can be adjusted according to required frequency responses by basic circuit analysis, and thus are not narrated herein. In addition, since the electrical coupling between the two series resonance circuits is performed by the inductor, an extra transmission zero is generated in a high frequency region of the pass-band by the second-order band-pass filter 10, so as to enhance the out-band rejection capability. However, for such second-order band-pass filters, the frequency response in a lower frequency part of the pass-band is still similar to that of a common second-order band-pass filter, which cannot satisfy out-band rejection requirements of the WLAN devices.

SUMMARY OF THE INVENTION

It is therefore an objective of the present invention to provide a second-order band-pass filter and a wireless apparatus using the same.

According to the present invention, a second-order band-pass filter for generating at least two transmission zeros is disclosed. The second-order band-pass filter includes a first signal terminal, a second signal terminal, a first transmission line resonator, a second transmission line resonator and an impedance inverter. The first transmission line resonator is formed with a plurality of bending, and has one end coupled to the first signal terminal and another end being open-circuit toward a first direction. The second transmission line resonator is symmetric to the first transmission line resonator and formed with a plurality of bending, and has one end coupled to the second signal terminal and another end being open-circuit toward a second direction, wherein the first direction is opposite to the second direction. The impedance inverter is coupled between the first transmission line resonator and the second transmission line resonator, and includes an inductor, a first micro strip line and a second micro strip line. The first micro strip line has one end coupled to the first signal terminal and another end coupled to a ground through the inductor. The second micro strip line is symmetric to the first micro strip line, and has one end coupled to the second signal terminal and another end coupled to the ground through the inductor.

According to the present invention, a wireless apparatus is further disclosed. The wireless apparatus includes a transceiver and a second-order band-pass filter. The transceiver is utilized for receiving or transmitting a radio signal. The second-order band-pass filter is coupled to the transceiver, and is utilized for filtering the radio signal. The second-order band-pass filter includes a first signal terminal, a second signal terminal, a first transmission line resonator, a second transmission line resonator and an impedance inverter. The first transmission line resonator is formed with a plurality of bending, and has one end coupled to the first signal terminal and another end being open-circuit toward a first direction. The second transmission line resonator is symmetric to the first transmission line resonator and formed with a plurality of bending, and has one end coupled to the second signal terminal and another end being open-circuit toward a second direction, wherein the first direction is opposite to the second direction. The impedance inverter is coupled between the first transmission line resonator and the second transmission line resonator, and includes an inductor, a first micro strip line and a second micro strip line. The first micro strip line has one end coupled to the first signal terminal and another end coupled to a ground through the inductor. The second micro strip line is symmetric to the first micro strip line, and has one end coupled to the second signal terminal and another end coupled to the ground through the inductor.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
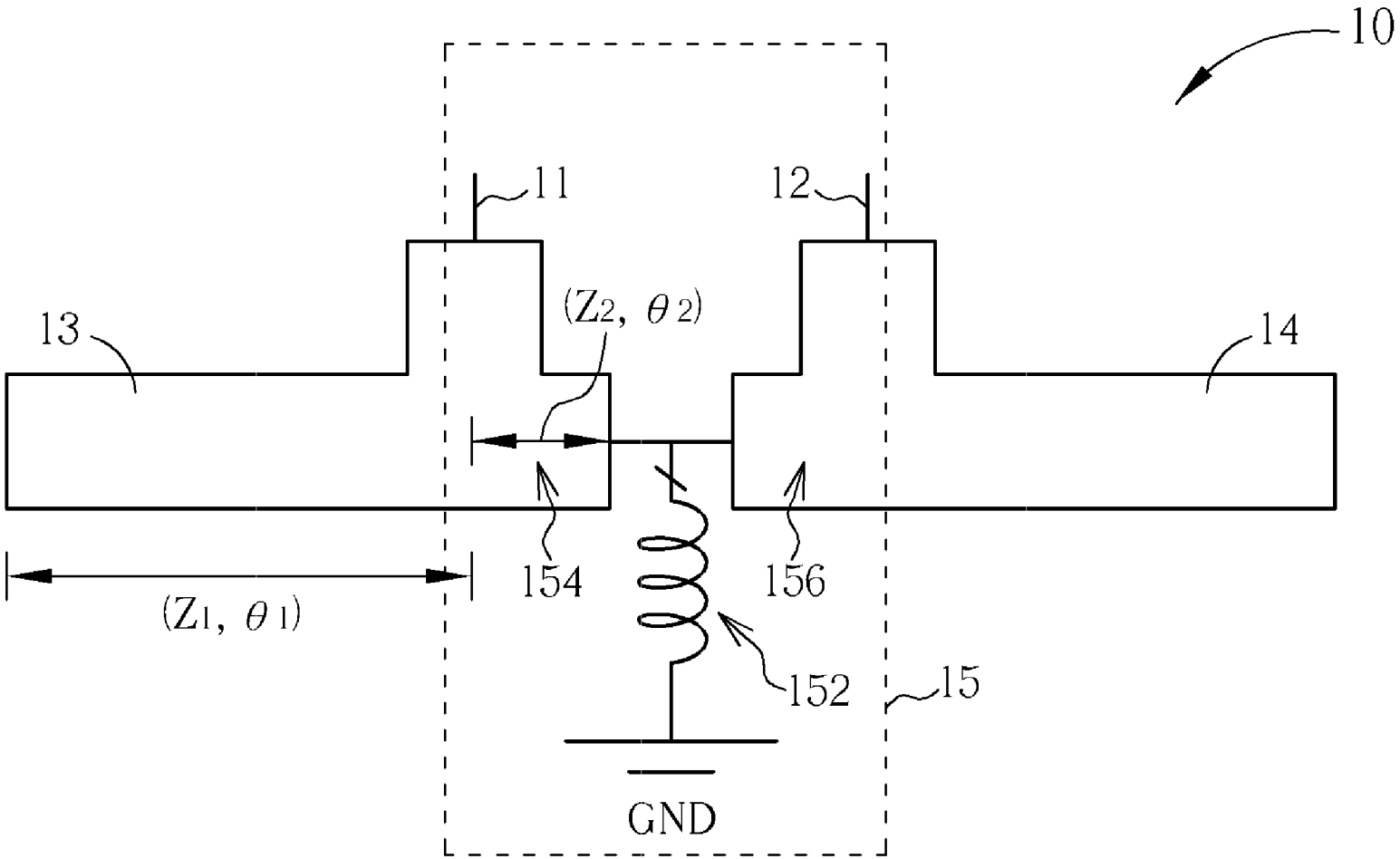
FIG. 1 PRIOR ART
FIG. 1 is a schematic diagram of a conventional second-order band-pass filter.
Figure 2:
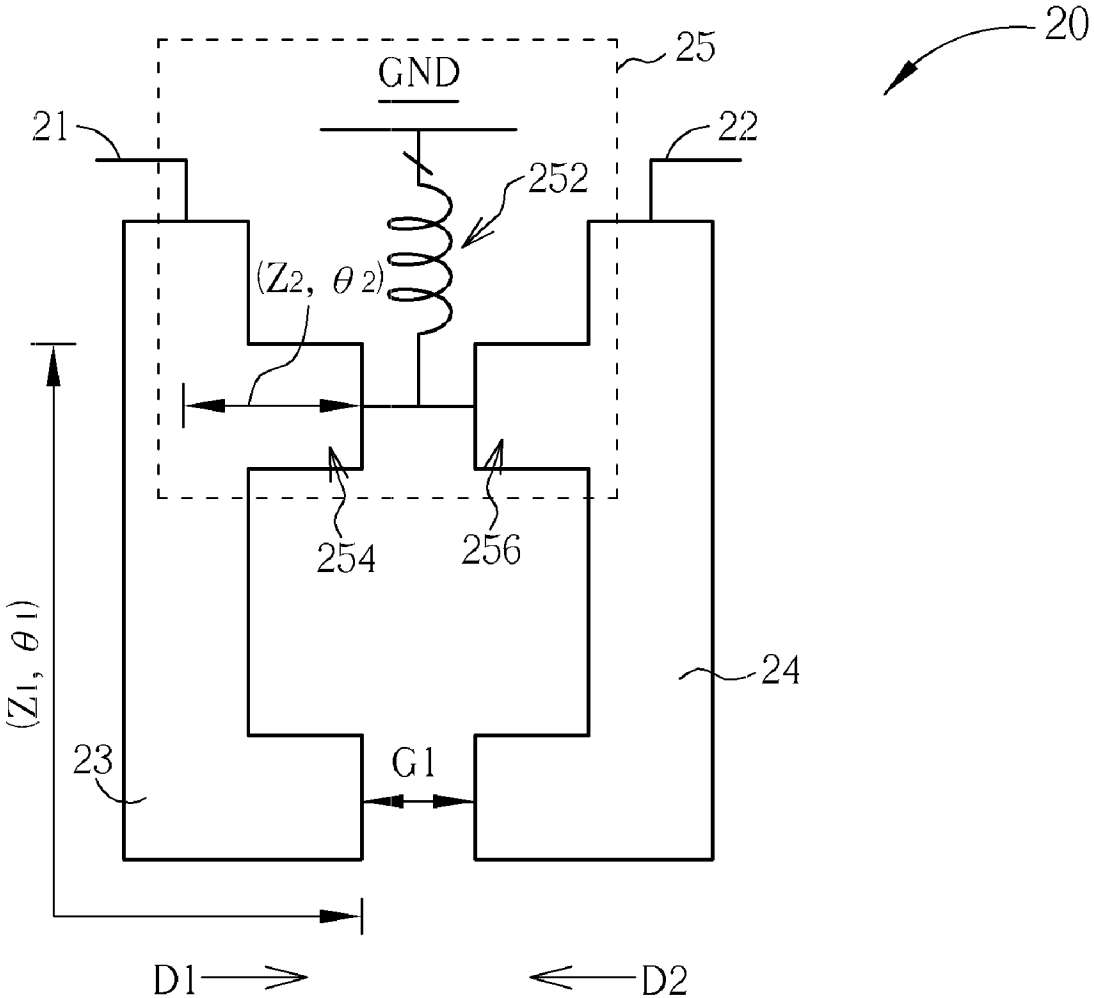
FIG. 2 is a schematic diagram of a second-order band-pass filter utilized for a wireless apparatus according to the present invention.

Please refer to FIG. 2. FIG. 2 is a schematic diagram of a second-order band-pass filter 20 utilized for a wireless apparatus according to the present invention. The second-order band-pass filter 20 is utilized for generating at least two transmission zeros, and includes a first signal terminal 21, a second signal terminal 22, a first transmission line resonator 23, a second transmission line resonator 24 and an impedance inverter 25. The first signal terminal 21 and the second signal terminal 22 are for the use of signal input and output. The first transmission line resonator 23 is formed by bending a quarter-wavelength open stub, and has one end coupled to the first signal terminal 21 and the other end open-circuited in a first direction D1. The second transmission line resonator 24 is symmetric to the first transmission line resonator 23 and formed by bending a quarter-wavelength open stub as well, and has one end coupled to the second signal terminal 22 and the other end open-circuited in a second direction D2. The first direction D1 is opposite to the second direction D2, so there is a gap G1 formed by the terminals of the first transmission line resonator 23 and the second transmission line resonator 24. The impedance inverter 25 is coupled between the first transmission line resonator 23 and the second transmission line resonator 24, and includes an inductor 252, a first micro strip line 254 and a second micro strip line 256. The first micro strip line 254 has one end coupled to the first signal terminal 21, and the other end coupled to a ground GND through the inductor 252. The second micro strip line 256 is symmetric to the first micro strip line 254, and has one end coupled to a second signal terminal 22 and the other end coupled to the ground GND through the inductor 252. In addition, characteristic impedance and electrical length of the first transmission line resonator 23 and the second transmission line resonator 24 are represented by Z1 and$\theta$1; and those of the first micro strip line 254 and the second micro strip line 256 are represented by Z2 and$\theta$2, respectively.

Therefore, compared with the prior art, the second-order band-pass filter 20 of the present invention bends two quarter-wavelength open stubs (i.e. the first transmission line resonator 23 and the second transmission line resonator 24) to form a cross-coupling structure for providing another signal transmission path to generate a transmission zero in a low frequency part of the pass-band. In this case, the second-order band-pass filter 20 not only has a steep cut-off frequency response characteristic for enhancing out-band rejection capability, but also reduces occupied PCB area significantly.

That means, since the quarter-wavelength open stub is equivalent to a series resonance circuit, and electrical coupling between the two series resonance circuits is performed by the inductor, a first transmission zero can thus be generated in a high frequency part of a pass-band by the second-order band-pass filter 20. On the other hand, by the cross coupling structure formed by bending the two quarter-wavelength open stubs, there further exists a second signal transmission path formed by the first transmission line resonator 23 and the second transmission line resonator 24 in the second-order band-pass filter 20, except for a first signal transmission path formed by the first micro strip line 254 and the second micro strip line 256. In this case, phase difference generated by signals passing through the first signal path and the second signal path, respectively, may generate a second transmission zero in a low frequency part of the pass-band by the second-order band-pass filter 20.

That is to say, in the second-order band-pass filter 20, each length of the first transmission line resonator 23 and the second transmission line resonator 24 is substantially equal to one-quarter of a wavelength corresponding to a frequency of the first transmission zero located at the high frequency part of the pass-band, and signals corresponding to a frequency of the second transmission zero may have same amplitudes with opposite phases when passing through the first signal transmission path and the second signal transmission path, respectively.

Note that circuit analysis can be performed in the present invention for the second-order band-pass filter 20 by even mode/odd mode excitation to obtain corresponding parameters, such as input impedance of even mode and odd mode, reflection coefficients, scattering parameters, etc., so that locations of the first transmission zero and the second transmission zero can be designed to meet out-band rejection requirements of the WLAN devices according to demanded frequency responses.

Figure 3:
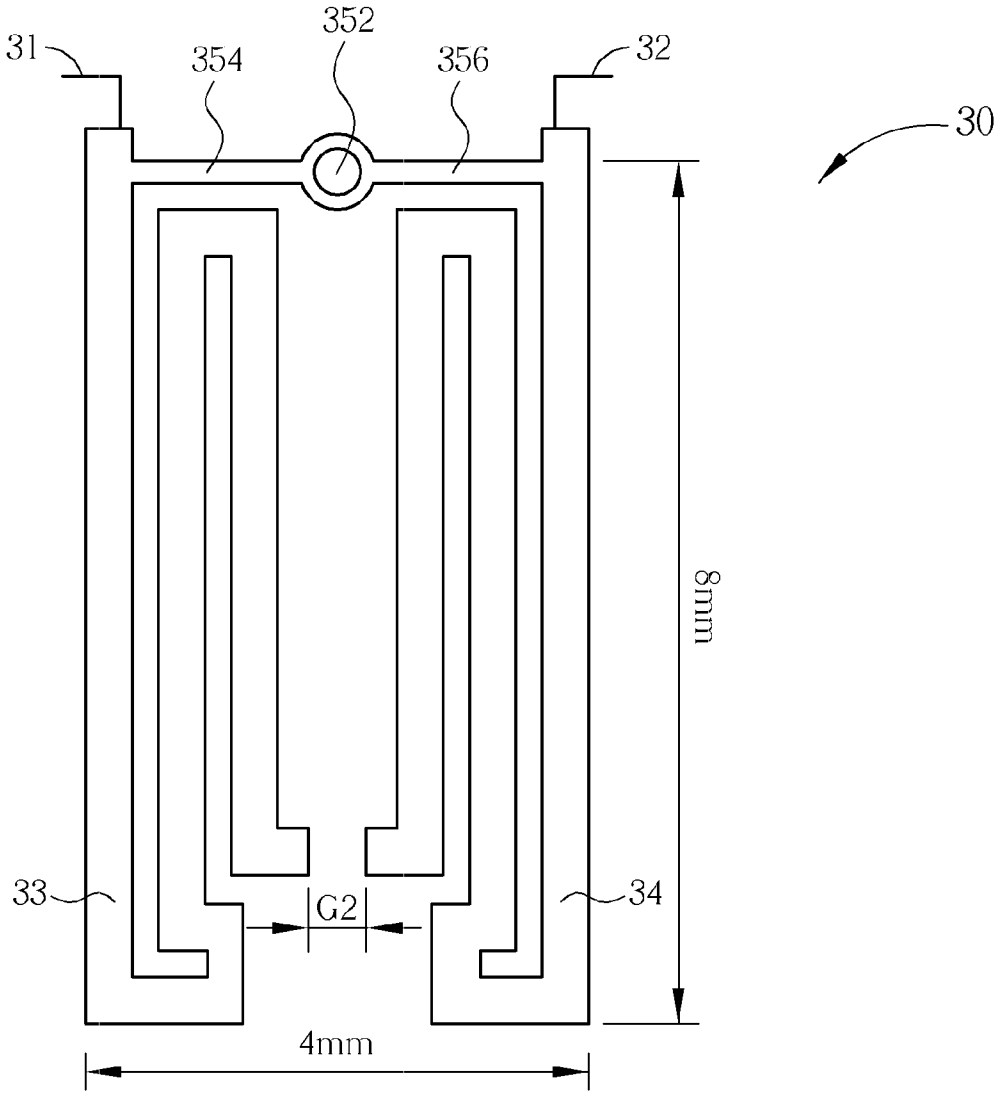
FIG. 3 is a schematic diagram of a second-order band-pass filter utilized in a wireless apparatus according to an embodiment of the present invention.

Please refer to FIG. 3. FIG. 3 is a schematic diagram of a second-order band-pass filter 30 utilized in a wireless apparatus, such as a wireless network card, according to an embodiment of the present invention. The second-order band-pass filter 30 is realized in an FR4 dielectric substrate, which has the following parameters: relative permittivity $\epsilon r=4.3$, thickness h=0.8 mm and loss tangent tan $\delta=0.02$. As shown in FIG. 3, the second-order band-pass filter 30 is substantially similar to the second-order band-pass filter 20, wherein the first transmission line resonator 33 and the second transmission line resonator 34 are formed with a plurality of bendings, respectively, and there exists an open-circuit gap G2 between terminals of the first transmission line resonator 33 and the second transmission line resonator 34. In addition, a via is grounded to form an inductor 352 of the impedance inverter 35, and the overall layout size of the second-order band-pass filter 30 is roughly 4 mm*8 mm.

Figure 4:
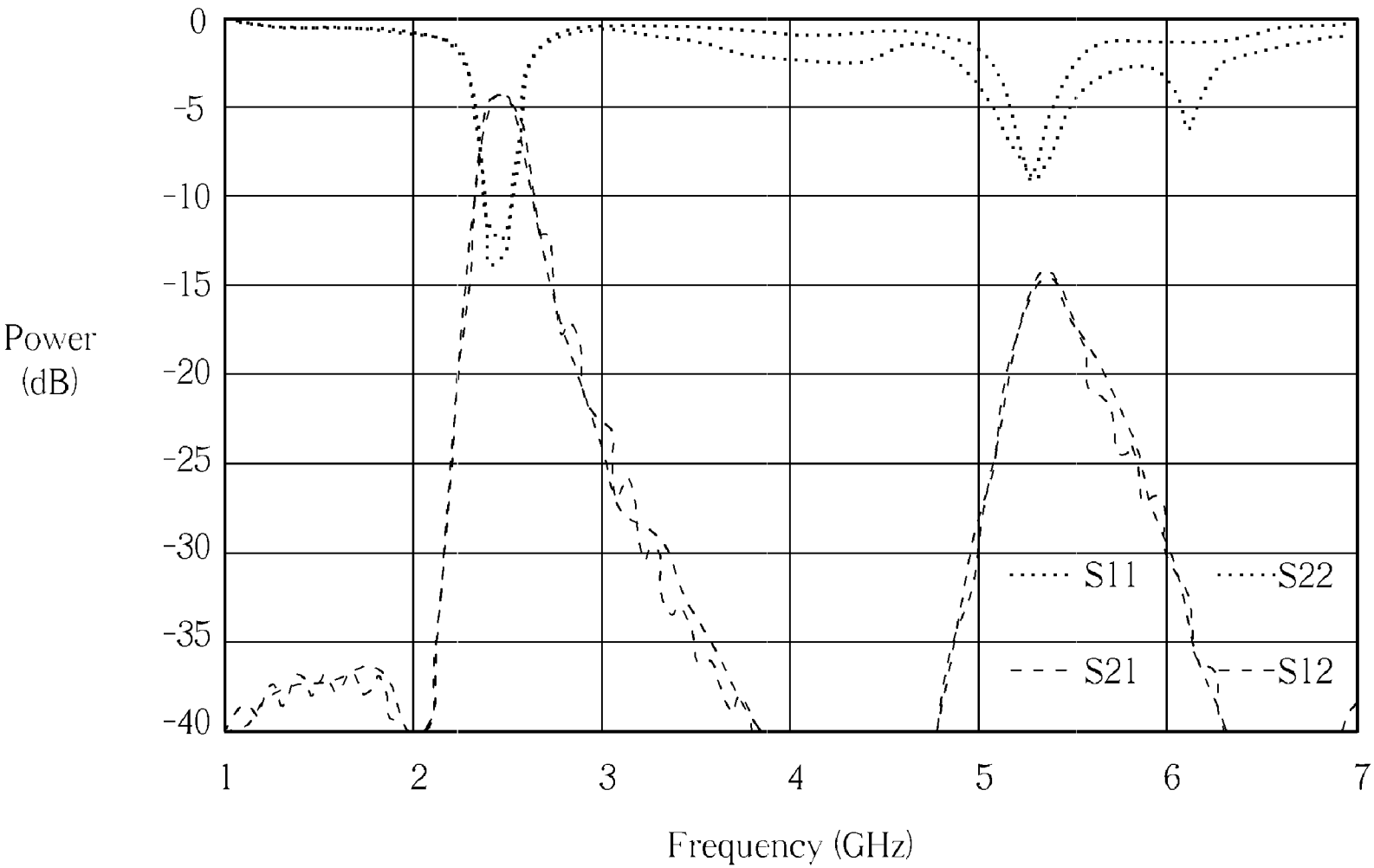
FIG. 4 is a frequency response diagram of a second-order band-pass filter in FIG. 3.

Please further refer to FIG. 4. FIG. 4 is a frequency response diagram of a second-order band-pass filter 30 in FIG. 3. FIG. 4 illustrates the actual measurement results of scattering parameters S11, S112, S21 and S22, in which the transverse axis and the longitudinal axis respectively represent frequency (GHz) and power (dB). As shown in FIG. 4, the pass-band of the second-order band-pass filter 30 is roughly located between 2.412 GHz~2.484 GHz with a center frequency designed to be 2.45 GHz. It can be seen that, in the scattering parameters S12 and S21, pass-band insertion loss of the second-order band-pass filter 30 is about 4.5 dB, and in the scattering parameters S11 and S22, reflection loss of the pass-band is less than 10 dB. Thus, the frequency response characteristic of the second-order band-pass filter 30 is good enough to meet out-band rejection requirements of the wireless network cards.

As mentioned above, the second-order band-pass filter of the present invention bends two quarter-wavelength open stubs to form a cross coupling structure for providing another signal transmission path to generate a transmission zero in a low frequency part of the pass-band. Therefore, the second-order band-pass filter of the present invention not only has a steep cut-off frequency response characteristic for enhancing out-band rejection capability, but further reduces occupied PCB area as well.

Those skilled in the art will readily observe that numerous modifications and alterations of the device and method may be made while retaining the teachings of the invention.

What is claimed is:

1. A second-order band-pass filter comprising:
- a first signal terminal;
- a second signal terminal;
- a first transmission line resonator, formed with a plurality of bendings, having one end coupled to the first signal terminal and another end open-circuited in a first direction;
- a second transmission line resonator, symmetric to the first transmission line resonator and formed with a plurality of bendings, having one end coupled to the second signal terminal and another end open-circuited in a second direction opposite the first direction; and
- an impedance inverter, coupled between the first transmission line resonator and the second transmission line resonator, comprising:
  - an inductor;
  - a first micro strip line having one end coupled to the first signal terminal and another end coupled to a ground through the inductor; and
  - a second micro strip line, symmetric to the first micro strip line, having one end coupled to the second signal terminal and another end coupled to the ground through the inductor.

2. The second-order band-pass filter of claim 1, wherein the inductor is formed by a via.

3. The second-order band-pass filter of claim 1, wherein a center frequency of a pass-band of the second-order band-pass filter is substantially located at 2.45 GHz.

4. The second-order band-pass filter of claim 1, wherein lengths of the first transmission line resonator and the second transmission line resonator are substantially equal to one-quarter of a wavelength corresponding to a frequency of a first transmission zero of the second-order band-pass filter.

5. The second-order band-pass filter of claim 4, wherein the first transmission zero corresponds to an upper cut-off frequency in a pass-band of the second-order band-pass filter.

6. The second-order band-pass filter of claim 1, wherein the first transmission line resonator and the second transmission line resonator form a first signal path, the first micro strip line and the second micro strip line form a second signal path, and signals corresponding to a frequency of a second transmission zero of the second-order band-pass filter generate converse phases when passing through the first signal path and the second signal path.

7. The second-order band-pass filter of claim 6, wherein the second transmission zero corresponds to a lower cut-off frequency in a pass-band of the second-order band-pass filter.

8. The second-order band-pass filter of claim 1, wherein the second-order band-pass filter is formed on a dielectric substrate.

9. The second-order band-pass filter of claim 8, wherein the dielectric substrate is an FR4 fiberglass substrate.

10. A wireless apparatus comprising:
- a transceiver for receiving or transmitting a radio signal; and
- a second-order band-pass filter, coupled to the transceiver, for filtering the radio signal, the second-order band-pass filter comprising:
  - a first signal terminal;
  - a second signal terminal;
  - a first transmission line resonator, formed with a plurality of bendings, having one end coupled to the first signal terminal and another end open-circuited in a first direction;
  - a second transmission line resonator, symmetric to the first transmission line resonator and formed with a plurality of bendings, having one end coupled to the second signal terminal and another end open-circuited in a second direction opposite the first direction; and
  - an impedance inverter, coupled between the first transmission line resonator and the second transmission line resonator, comprising:
    - an inductor;
    - a first micro strip line having one end coupled to the first signal terminal and another end coupled to a ground through the inductor; and
    - a second micro strip line, symmetric to the first micro strip line, having one end coupled to the second signal terminal and another end coupled to the ground through the inductor.

11. The wireless apparatus of claim 10, wherein the inductor is formed by a via.

12. The wireless apparatus of claim 10, wherein a center frequency of a pass-band of the second-order band-pass filter is substantially located at 2.45 GHz.

13. The wireless apparatus of claim 10, wherein lengths of the first transmission line resonator and the second transmission line resonator are substantially equal to one-quarter of a wavelength corresponding to a frequency of a first transmission zero of the second-order band-pass filter.

14. The wireless apparatus of claim 13, wherein the first transmission zero corresponds to an upper cut-off frequency in a pass-band of the second-order band-pass filter.

15. The wireless apparatus of claim 10, wherein the first transmission line resonator and the second transmission line resonator form a first signal path, the first micro strip line and the second micro strip line form a second signal path, and signals corresponding to a frequency of a second transmission zero of the second-order band-pass filter generate converse phases when passing through the first signal path and the second signal path.

16. The wireless apparatus of claim 15, wherein the second transmission zero corresponds to a lower cut-off frequency in a pass-band of the second-order band-pass filter.

17. The wireless apparatus of claim 10, wherein the second-order band-pass filter is formed on a dielectric substrate.

18. The wireless apparatus of claim 17, wherein the dielectric substrate is an FR4 fiberglass substrate.

* * * * *